US006073771A

United States Patent [19]

Pressley et al.

[11] Patent Number: 6,073,771

[45] Date of Patent: Jun. 13, 2000

[54] CONTAINER FOR STORING SULFUR-CONTAINING COMPOUNDS

[75] Inventors: Mark W. Pressley, Apex; Kirk J. Abbey, Raleigh, both of N.C.

[73] Assignee: Lord Corporation, Cary, N.C.

[21] Appl. No.: 09/184,476

[22] Filed: Nov. 2, 1998

[51] Int. Cl.[7] ..... B65D 85/84

[52] U.S. Cl. ..... 206/524.4; 206/204; 206/213.1

[58] Field of Search ..... 206/204, 205, 206/524.4, 524.5, 213.1

[56] References Cited

U.S. PATENT DOCUMENTS

| | | |
|---|---|---|
| 4,435,371 | 3/1984 | Frech et al. . |
| 4,701,303 | 10/1987 | Nevers . |
| 5,457,234 | 10/1995 | Shaw . |
| 5,700,438 | 12/1997 | Miller . |
| 5,741,415 | 4/1998 | Mazgarov et al. . |

*Primary Examiner*—Paul T. Sewell
*Assistant Examiner*—J. Mohandesi
*Attorney, Agent, or Firm*—Burns, Doane, Swecker & Mathis, L.L.P.

[57] ABSTRACT

Containers for storing and/or transporting sulfur-containing compounds, and methods of deodorizing headspace gases containing sulfur-containing compounds, are disclosed. The containers include a body and a lid. In one embodiment, copper or another sulfur-deodorizing substance is attached to either the lid or upper sides of the container or is suspended in the headspace. The sulfur-deodorizing substance reacts with or adsorbs or absorbs any sulfur-containing compounds present in the headspace volume to reduce the odor in the headspace. In another embodiment, when the container include a solid or viscous liquid sulfur-containing compound, a pouch containing a sulfur-deodorizing substance is placed on top of the sulfur-containing compound. The pouch includes a liner or a sealed side in immediate contact with the solid or viscous liquid sulfur-containing compound, and a non-contacting portion providing a breathable, porous construction to permit the headspace gases to come into contact with the sulfur-deodorizing substance.

18 Claims, 1 Drawing Sheet

CONTAINER FOR STORING SULFUR-CONTAINING COMPOUNDS

FIELD OF THE INVENTION

The present invention relates to containers for storing non-volatile sulfur-containing materials, in particular, containers that include a means for neutralizing any sulfur-containing gases in the headspace of the container.

BACKGROUND OF THE INVENTION

Sulfur-containing compounds are typically associated with a noxious odor. There are many situations in which this odor is beneficial. For example, small amounts of sulfur-containing compounds, for example, ethyl or methyl mercaptan, are added to liquid propane gas (LPG) and natural gas. LPG and natural gas themselves do not have an associated odor, and the presence of the methyl mercaptan allows one to detect the presence of the gases.

There are also many situations in which the sulfur-containing compounds are not beneficial. For example, hydrogen sulfide, which has a strong odor, is more toxic than hydrogen cyanide. Mercaptans and related compounds, such as thiolacetic acid, are extremely unpleasant to work with due to the associated noxious odor.

Hydrogen sulfide is known to react with and corrode copper metal and also numerous copper alloys via the formation of copper sulfide. This knowledge has been exploited commercially in industrial processes to scrub toxic hydrogen sulfide from off gases in large reactors.

For example, U.S. Pat. No. 5,700,438 to Miller discloses a process for removing hydrogen sulfide and mercaptans from gas streams. The process involves contacting gas streams with aqueous solutions of copper ammines, in which copper exists in the zero oxidation state, to form copper sulfide. The precipitation of copper sulfide frees up the amine used to form the copper ammine and allows it to react with additional copper to keep the concentration of the copper ammine relatively constant.

U.S. Pat. No. 5,741,415 to Mazgarov et al. discloses a process for the demercaptanization of petroleum distillates. The process involves oxidizing the mercaptans present in the distillates by contacting them with oxygen at elevated temperatures in the presence of a water-soluble copper ion. The copper ion is present on a fibrous carbonaceous material, such as a fabric, felt, rope or twisted strand.

U.S. Pat. No. 4,435,371 to Frech and Tazuma discloses a process for removing hydrogen sulfide, sulfides and mercaptans from a gas stream by contacting the gas stream with copper oxide, introducing ammonia onto the metal oxide, and then introducing hydrogen peroxide onto the metal oxide.

U.S. Pat. No. 5,457,234 to Shaw discloses a method for reducing the metal corrosiveness of an organic polysulfide by contacting the polysulfide with copper at an elevated temperature.

U.S. Pat. No. 4,701,303 to Nevers discloses a process for preventing a mercaptan from reacting with a metal container. The Nevers process involves pre-treating the container with benzotriazole, tolyl triazole, mercaptobenzothiazole, benzothiazyl disulfide or mixtures thereof. Nevers specifically teaches that it is beneficial to avoid having the mercaptan be deodorized for certain applications, namely, when the odor is essential for purposes of alerting one to potential leakage of liquid propane gas (LPG) or natural gas.

None of the foregoing references describe a solution for the problems of removing the noxious odors associated with sulfur-containing compounds present in storage or shipment containers including such compounds.

It would be advantageous to provide a container for transporting or storing sulfur-containing compounds that minimizes the presence of sulfur-containing compounds in the headspace of the container, such that those individuals opening the container would not be exposed to large amounts of noxious fumes. The present invention provides such a container.

SUMMARY OF THE INVENTION

Containers useful for storing and/or transporting sulfur-containing compounds, and methods of deodorizing headspace gases over sulfur-containing compounds, are disclosed.

The containers include elemental copper or a suitable copper alloy or other sulfur-deodorizing material, as defined hereinbelow, positioned to come into contact with the headspace gases. It is most preferred that the elemental copper, suitable alloy or other sulfur-deodorizing substance is positioned in such a manner that it does not come into contact with the solid or liquid contents of the container. The headspace gases, wherein traces of odorous, sulfur-containing impurities are present, make contact with the sulfur-deodorizing substance and the trace level sulfur compounds react with or become absorbed or adsorbed by the sulfur-deodorizing substance and therefore the headspace gases become deodorized.

The container itself can be in any suitable form for storage or transportation of sulfur-containing compounds. Preferably, the container has a lid, which is removed to allow access to the compounds from the inside of the container. However, any container which maintains a suitable headspace can be used. The size of the container is of no consequence provided that a suitable amount of copper or other sulfur-deodorizing substance for neutralizing any headspace sulfur-containing gases is present. Those of skill in the art can readily determine an appropriate amount of copper or sulfur-deodorizing substance to keep in the headspace to effectively neutralize the sulfur-containing compounds.

When the sulfur-deodorizing substance is copper, it can be in any suitable form for reacting with the sulfur-containing compounds. Generally, it is preferred that the copper is in a form which has a relatively high surface area. Accordingly, copper wire, tape, felt, gauze, wool, shot, and other types of high surface area materials are preferred.

Any sulfur-containing compound that reacts with or is absorbed or adsorbed by the copper or other sulfur-deodorizing substance can be deodorized. Examples include hydrogen sulfide, aliphatic and aromatic mercaptans, such as alkyl mercaptans, aryl mercaptans, alkaryl mercaptans, and aralkyl mercaptans.

In a preferred embodiment, the copper or other sulfur-deodorizing substance is maintained in such a way that it avoids contact with the contents of the container other than the headspace gases. One means for doing this is to store the sulfur-deodorizing substance in an enclosure, such as a bag, which is impermeable to liquids but permeable to gases such as sulfur-containing gases.

In another embodiment, when the container is used to store solids or viscous liquids, a pouch containing the sulfur-deodorizing substance can be placed on top of the solid or viscous liquid. Preferably, the pouch or other container includes a liner or a sealed side in immediate contact with the sulfur-containing compound, with the non-contacting portion of the pouch providing a breathable, porous construction to allow contact of the sulfur-deodorizing substance with the headspace gases.

When the sulfur-deodorizing substance is copper, the container is inappropriate for storage or transport of compounds such as acetylenes which are known to react with copper to form explosive compounds.

DETAILED DESCRIPTION OF THE INVENTION

Containers useful for storing and/or transporting sulfur-containing compounds, and methods of deodorizing sulfur-containing compounds, are disclosed.

Containers

Any suitable container can be used which is typically used to store and/or transport chemical compounds. The containers include elemental copper or another sulfur-deodorizing substance in such a manner that the sulfur-deodorizing substance does not come into contact with the contents of the container other than the headspace gases. Preferably, the container has a lid, which is removed to allow access to the compounds from the inside of the container. However, any container which maintains a suitable headspace can be used. The size of the container is of no consequence provided that a suitable amount of sulfur-deodorizing substance for neutralizing the headspace sulfur-containing compounds is present.

The sulfur-containing gases in contact with the sulfur-deodorizing substance react with or are absorbed or adsorbed by the sulfur-deodorizing substance and therefore become deodorized. Those of skill in the art can readily determine an appropriate amount of copper to keep in the headspace to effectively neutralize the sulfur-containing compounds.

As used herein, an effective amount of copper for use in neutralizing the trace levels of sulfur-containing compounds present in the headspace gases is at least about a stoichiometric amount of copper. However, sorption and reaction of the trace levels of sulfur-containing compounds is initially at the surface of the metal. Subsequent diffusion, or reorganization of the surface to allow greater capacity is dependent upon the particular sulfur compound present. It is therefore most preferred to have a very large excess of copper, present in a high surface area form, for reacting with the expected trace amounts of headspace sulfur-containing compounds present in the container. Similarly, when other sulfur-deodorizing substances are used, it is preferred that they are present in a relatively large excess.

The material composition of the containers of this invention are only limited by the safe packaging for the bulk composition contained therein and the storage and shipping requirements placed thereupon. Commonly used containers are made of thermoset-coated steel, stainless steel, including Monel stainless steel, plastic, such as polyethylene, polypropylene, polypentalene, polyhalogenated plastics such as polyvinyl chloride and polyvinylidene chloride, and polymer alloys or blends of such materials, or plastic lined fiber board or cardboard, and the like.

Figure 1:
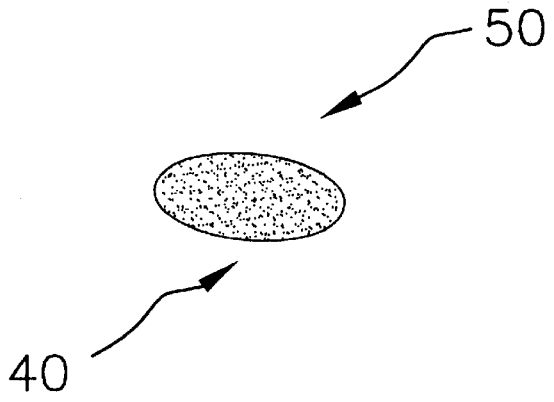
FIG.1 is a schematic illustration of the bottom side of a lid for fitting on the containing in FIG. 2. The lines in the figure represent pieces of copper attached to the bottom side of the lid.
Figure 2:
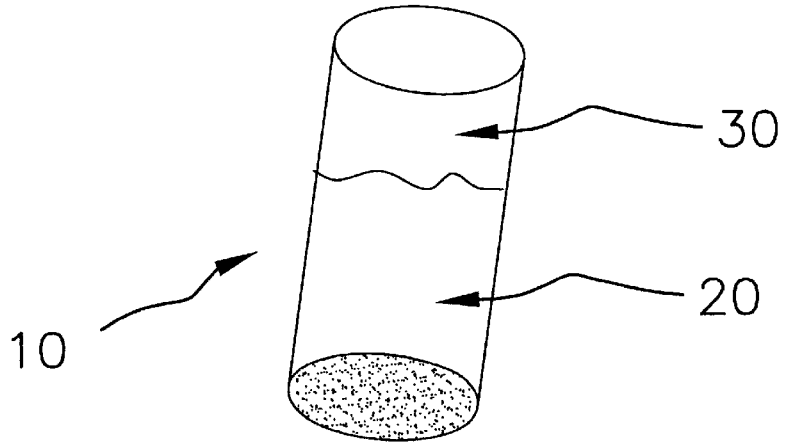
FIG. 2 is a schematic illustration of a container for storing and/or transporting sulfur-containing compounds.
Figure 3:
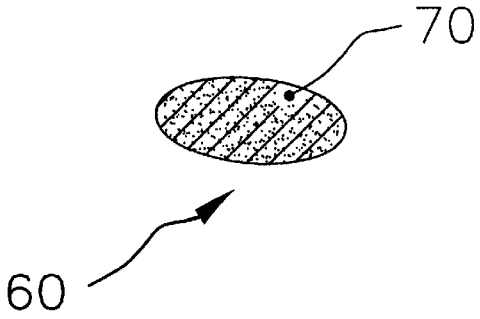
FIG. 3 is a schematic illustration of the bottom side of the lid.

In one embodiment, the container is as shown in FIG. 2. 10 represents the body of the container. 20 represents a liquid or solid containing trace amounts of hydrogen sulfide or a volatile aliphatic or aromatic sulfur compound. 30 represents the headspace. In FIG. 1, 40 represents the bottom side of the lid in contact with the headspace when the lid is in contact with the body of the container. 50 represents the top side of the lid which is not in contact with the headspace gases when the lid is in contact with the body of the container. A schematic illustration of the bottom side of the lid is shown in FIG. 3. 60 represents the bottom side of the lid. 70 represents individual pieces of copper adhered to the bottom side of the lid. The lid is releasably attached to the container which means that it can be at least partly opened to access the contents of the container.

In another embodiment, when the container is used to store solids or viscous liquids, a pouch containing copper or another suitable sulfur-deodorizing substance can be placed on top of the solid or viscous liquid. Preferably, the pouch or other container includes a liner or a sealed side in immediate contact with the sulfur-containing compound, with the non-contacting portion of the pouch providing a breathable, porous construction to allow contact of the sulfur-deodorizing substance with the headspace gases.

Copper

Copper and any of its useful alloys which are known to react with sulfur-containing compounds can be used. Useful alloys of copper which react with hydrogen sulfide and aliphatic and aromatic mercaptans are well known to those of skill in the art. For example, suitable copper alloys include various brass and bronze compositions. The copper can be in the form of wire, tape, felt, gauze, wool, shot and the like. It is most preferred that the copper metal or alloy be present in a high surface area form.

The copper present in the headspace reacts with the trace levels of sulfur-containing compounds to form copper sulfide or other copper coordinated compounds, thereby reducing the odor associated with the headspace gases.

An effective, odor reducing amount of copper can be readily determined by those of skill in the art. For example, one can readily measure the amount of headspace in a container. Depending on the anticipated storage time for the compounds in the container, using standard calculations and measurements, one can determine an anticipated partial pressure over time for the sulfur-containing gases. Based on the number of moles of sulfur-containing compounds per unit volume of gas, one can calculate the minimum number of gram atoms of copper needed to deodorize the anticipated number of moles of sulfur-containing compounds. Because an equilibrium will exist between the bulk material and the headspace gas, and will tend to re-establish equilibrium as the sulfur-containing gases are neutralized, a large excess of copper (or other neutralizing agent) over that which might be expected should be used.

Because of the several limitations in knowing the reaction and reorganizational rates described herein, an empirical evaluation for any given application is best performed to ensure the desired level of control is achieved.

Sulfur-containing Compounds

Any compound or material which contains or which produces sulfur-containing compounds which become volatilized into the headspace of a container can be deodorized using the containers described herein. Examples of compounds or materials which contain or which emit sulfur-containing compounds include various adhesives, rubbers, sealers, coatings, encapsulants, printing materials, including inks, and the like.

Optional Components

In addition to, and, optionally, in place of copper, the container can include compounds known to deodorize sulfur, including transition and noble metals (including their ions and salts), molecular sieves, activated carbon, biofilters, and the like.

Methods of Maintaining Copper in the Headspace

Copper can be maintained in the headspace, for example, by lining the lid with copper in any suitable form, such as wire, tape, felt, gauze, wool, shot and the like. In one embodiment, the copper is placed inside a porous material, such as a breathable cloth or plastic bag, and held in the headspace.

Copper can be electroplated or affixed onto the container lid via suitable mechanical fasteners, such as rivets, bolts, or Velcro™, or various adhesives, such as pressure sensitive adhesive tape. However, in this latter embodiment, the tape or adhesive must be compatible with the other components in the container. Suitable adhesives for adhering copper to another metal are also well known to those of skill in the art. Examples include epoxy resins, urethane glues, and cyanoacrylates. Those of skill in the art can readily determine an appropriate adhesive which is compatible for use with a particular material to be stored or transported.

Copper can also be attached to the lid of the container using brazing or welding techniques. Tig welding is especially preferred for welding copper to other metals. Brazing can be preferred due to the relative ease of this method and also due to the relatively low cost of the materials and equipment.

In one embodiment, a means for preventing liquid materials present in the container from contacting the copper, or other hydrogen sulfide scavenging medium, are used. These help avoid overwhelming the copper or other sulfur scavenging medium with the relatively non-volatile main composition present in the liquid or solid in the container. In a preferred embodiment, the copper or other scavenging medium is enclosed within a membrane which is insoluble and non-reactive with, and preferably non-wetting by, the liquid material stored and/or transported in the container, and yet allows ready diffusion of the hydrogen sulfide or sulfur compound-containing gases into the scavenging medium to ensure the continued efficacy of the adsorbing medium. Molecular sieves, which consist of various natural and synthetic zeolitic structures, are also suitable for absorbing hydrogen sulfide, linear alkyl mercaptans, sulfides, or disulfides.

EXAMPLES

The containers described herein will be further understood with reference to the following non-limiting examples.

Example 1

Evaluation of Headspace Hydrogen Sulfide Concentration

An adhesive formulation was prepared that contained CapCure 3-800 (Henkel Corp.) as a non-volatile polymercaptan material. This formulation was placed in a small bottle, leaving about one inch of headspace. Table 1 below contains information about what was done to control odor as well as data obtained from a PhD Plus (Biosystems, inc.) monitoring unit for $H_2S$ levels (ppm).

TABLE 1

| Method used to control odor | Day 1 (ppm) | Day 25 (ppm) | Day 39 (ppm) | Day 47 (ppm) |
|---|---|---|---|---|
| None (control) | 27 | 35 | Skinned over | NM |
| Plastic sheet on top of formulation | 13 | 7 | 0 | 6 |
| −2 + 6" 20 AWG bare Cu wire | 0 | 0 | 0 | 0 |
| 6" 20 AWG bare Cu wire | 0 | 0 | Skinned over | NM |
| 12" 20 AWG bare Cu wire | 0 | 0 | Skinned over | NM |

NM = not measured

A plastic sheet was cut to fit into the inside diameter of the bottle to cover the surface of the material. A piece of clean copper wire, the dimensions of which are indicated above in Table 1, was rolled into a small ball and was adhered to the lid of the bottle with a pressure sensitive tape to help avoid contact with the polymercaptan. The materials that had skinned over was not monitored because the skin formation was considered as a undesired performance which interfered with the re-equilibration of hydrogen sulfide.

As shown in Table 1, the presence of the copper wire in the headspace reduced the amount of hydrogen sulfide in the headspace to 0 ppm. However, a significant amount of hydrogen sulfide was present in the headspace of the control containers (i.e., containers which did not include copper wire in the headspace).

Example 2

Evaluation of Headspace hydrogen Sulfide Odor

Testing of a sealant formulation was done using the human nose as the odor detector. This formulation also contained Capcure 3-800 as the polymercaptan and was in a one gallon plastic container with about 4 inches of headspace. The clean copper wire (28 AWG) was placed inside a breathable cloth bag that would allow the headspace air to pass through it.

This cloth bag was then taped to the lid of the container. Table 2 shows the results of this experiment.

TABLE 2

| Formulation (lot #) | Method used to control odor | Day 4 odor | Day 6 odor | Day 10 odor |
|---|---|---|---|---|
| 7953-52 | None (control) | Strong mercaptan/$H_2S$ | Strong mercaptan/$H_2S$ | Strong mercaptan/$H_2S$ |
| 7953-53 | 36 g copper | No mercaptan/$H_2S$ | No mercaptan/$H_2S$ | No mercaptan/$H_2S$ |
| 7953-55 | 18 g copper | No mercaptan/$H_2S$ | No mercaptan/$H_2S$ | No mercaptan/$H_2S$ |

As shown in Table 2, the presence of copper wire in the headspace is very effective at minimizing the presence of hydrogen sulfide or other mercaptan odors in the headspace gases.

Those skilled in the art will recognize, or be able to ascertain using no more than routine experimentation, many equivalents to the specific embodiments of the invention described herein. Such equivalents are intended to be encompassed by the following claims.

What is claimed is:

1. A container for storing and/or transporting sulfur-containing compounds, comprising a body and a lid, wherein a) the lid comprises a top side and a bottom side, b) the body comprises an opening suitable for receiving the lid, c) the lid is capable of being releasably attached to the body, d) when the lid is releasably attached to the body, the top side of the lid is exposed to the outside of the container and the bottom side of the lid is exposed to the inside of the container, and e) an effective, odor-reducing amount of a sulfur-deodorizing substance selected from the group consisting of copper, transition metals, noble metals, ions thereof, and salts thereof is present on or attached to the bottom side of the lid or the sides of the container, wherein the sulfur-deodorizing substance be exposed to gases in a headspace, and separated from the sulfur-containing compound stored in the container.

2. The container of claim 1 wherein the sulfur-doedorizing substance is in the form of a copper tape, gauze, felt, wool, shot or wire.

3. The container of claim 1, wherein the sulfur-deodorizing substance is in the form of a piece of copper secured onto the inside surface of the container lid.

4. The container of claim 1, wherein the sulfur-deodorizing substance is in the form of a piece of copper electroplated onto the inside surface of the container lid.

5. The container of claim 1 wherein the sulfur-deodorizing substance is attached to the bottom side of the lid by means of being contained in a cloth or plastic bag or pouch which is in turn affixed either mechanically or adhesively to the lid or to the body of the container near the opening.

6. The container of claim 5 wherein the pouch is a non-reactive, insoluble, microporous plastic or cloth which preferably is non-wetted by the sulfur-containing compounds.

7. A method for storing and/or transporting sulfur-containing compounds comprising:

a) preparing a container comprising a body and a lid, wherein the lid includes an inside surface, b) adding the sulfur-containing compound to the container such that a headspace volume remains, and c) sealing the lid, wherein an effective, odor reducing amount of a sulfur-deodorizing substance selected from the group consisting of copper, transition metals, noble metals, ions thereof, and salts thereof is present in the headspace, and wherein the sulfur-deodorizing substance is not in contact with the compound other than in the headspace volume and wherein the sulfur-deodorizing substance be exposed to gases in a headspace, and separated from the sulfur-containing compound stored in the container.

8. The method of claim 7 wherein the sulfur-deodorizing substance is in the form of a copper tape, gauze, felt, wool, shot or wire.

9. The method of claim 7, wherein the sulfur-deodorizing substance is in the form of a piece of copper secured onto the inside surface of the container lid.

10. The method of claim 7, wherein the sulfur-deodorizing substance is in the form of a piece of copper electroplated onto the inside surface of the container lid.

11. A method for storing and/or transporting solid or viscous liquid sulfur-containing compounds comprising:

a) adding the sulfur-containing compound to a suitable container such that a headspace remains, b) placing an effective odor-reducing amount of a sulfur-deodorizing substance selected from the group consisting of copper, transition metals, noble metals, ions thereof, and salts thereof in a pouch or other suitable package which permits any volatile sulfur-containing compounds in the headspace to come into contact with the sulfur-deodorizing substance, and c) placing the pouch or other suitable package in the headspace, wherein the sulfur-deodorizing substance be exposed to gases in a headspace, and separated from the sulfur-containing compound stored in the container.

12. The method of claim 11, wherein the package includes a liner or a sealed side in immediate contact with the solid or viscous liquid sulfur-containing compound, and a non-contacting portion providing a breathable, porous construction to permit the headspace gases to come into contact with the sulfur-deodorizing substance.

13. The method of claim 11 wherein the sulfur-deodorizing substance is copper.

14. A container, comprising:

a body defining a vessel having an opening;

a lid adapted to cover the opening;

a sulfuric compound filling a portion of the vessel and defining a headspace between the sulfuric compound and the lid; and at least a stoichiometric amount of copper disposed within the headspace, whereby odorous sulfur-containing gases in the headspace may make contact with the copper such that the sulfur compounds in the gases react with the copper to reduce noxious odors in the headspace gases and wherein the sulfur-deodorizing substance be exposed to gases in a headspace, and separated from the sulfur-containing compound stored in the container.

15. The container of claim 14 wherein:

the copper is in the form of a tape, gauze, felt, wool, shot or wire.

16. The container of claim 14, wherein:

the copper is adhered to an inside surface of the container lid.

17. The container of claim 14, wherein:

the copper is electroplated to an inside surface of the container lid.

18. The container of claim 14, wherein:

the copper is attached to the bottom side of the lid by means of being contained in a cloth or plastic bag or pouch, which is in turn affixed either mechanically or adhesively to the lid.

* * * * *

UNITED STATES PATENT AND TRADEMARK OFFICE
CERTIFICATE OF CORRECTION

PATENT NO. : 6,073,771

DATED : June 13,2000

INVENTOR(S) : Mark W. Pressley and Kirk J. Abbey

It is certified that error appears in the above-identified patent and that said Letters Patent is hereby corrected as shown below:

In Brief Description of the Figures, column 3, line 11, delete "containing" and insert --container--;

In claim 1, column 7, line 12, delete "be" and insert --is--;

In claim 7, column 7, line 49, delete "be" and insert --is--;

In claim 11, column 8, line 17, delete "be" and insert --is--;

In claim 14, column 8, line 39, delete "be" and insert --is--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*